US005187960A

United States Patent [19]

Taguchi

[11] Patent Number: 5,187,960

[45] Date of Patent: Feb. 23, 1993

[54] APPARATUS FOR SUPPORTING REDUCTION ROLLS IN A ROLLING MILL

[75] Inventor: Ichizo Taguchi, Sakai, Japan

[73] Assignee: Hitachi Zosen Corporation, Osaka, Japan

[21] Appl. No.: 768,806

[22] Filed: Sep. 30, 1991

[30] Foreign Application Priority Data

Oct. 3, 1990 [JP] Japan ..... 2-267098

[51] Int. Cl.[5] ..... B21B 31/02; G01L 5/00

[52] U.S. Cl. ..... 72/19; 72/244; 72/237; 73/862.55

[58] Field of Search ..... 72/19, 20, 21, 28, 35, 72/244, 245, 246, 237; 73/862.55, 862.38; 100/163 A, 168, 170

[56] References Cited

U.S. PATENT DOCUMENTS 3,779,062 12/1973 Gegick ..... 72/244
3,987,657 10/1976 Properzi ..... 72/224
4,341,122 7/1982 Lechler et al. ..... 73/862.54
4,380,954 4/1983 Edele ..... 73/862.55
5,038,591 8/1991 Tajima et al. ..... 72/245

*Primary Examiner*—Lowell A. Larson
*Assistant Examiner*—Thomas C. Schoeffler
*Attorney, Agent, or Firm*—Barnes, Kisselle, Raisch, Choate, Whittemore & Hulbert

[57] ABSTRACT

An apparatus for supporting a plurality of reduction rolls in a rolling mill. The reduction rolls are individually supported by support structures within the mill housing. Load cells are disposed between one of the suppport structures and the mill housing, and support members are disposed between each of the other support structures and the mill housing. The overall rigidity of a first support system consisting of the support members and the corresponding support structure is equal to the overall rigidity of a second support system consisting of the load cells and the corresponding support structure. When rolling force is applied to the reduction rolls, elastic displacement of the reduction rolls is equalized, and no trouble is caused to rolling opertion despite the fact that load cells are provided at one site only.

3 Claims, 3 Drawing Sheets

APPARATUS FOR SUPPORTING REDUCTION ROLLS IN A ROLLING MILL

FIELD OF THE INVENTION

This invention relates to an apparatus for supporting reduction rolls in a rolling mill.

BACKGROUND OF THE INVENTION

A known three-roll rolling mill includes three reduction rolls radially arranged at angular intervals of 120 degrees in a vertical plane and adapted to be rotated to roll a metal strip from three peripheral sides so that the metal strip is formed into a metal bar, wire rod, or the like. Each reduction roll is conventionally supported at its opposite ends by a pair of bearings.

For purposes of controlling the rolling mill, it is generally known to equip the mill with load cells for detecting the rolling force. For mounting a load cell, it is preferable to utilize a space, for example, between each bearing and a mill housing. However, when load cells are installed for only one of the three reduction rolls, the problem is that the overall rigidity of a support system for the one reduction roll (which consists of the load cells, a roll holder, and a support frame) becomes different from the overall rigidity of a support system for each of the two other reduction rolls with no load cell installed therefor (which comprises a roll holder and a support frame). As such , no uniform elastic displacement is achievable with respect to individual reduction rolls during rolling operation, product quality being thus adversely affected.

In order to eliminate such inconvenience, it may be conceivable to provide load cells with respect to all the reduction rolls. However, this naturally involves increased cost.

Furthermore, it may sometimes be impracticable to provide load cells for all the reduction rolls because of limited space availability.

SUMMARY OF THE INVENTION

Therefore, it is a primary object of the invention to provide for equalization of elastic displacement with respect to individual reduction rolls during rolling operation, with not all the reduction rolls being required to have load cells mounted thereto.

In order to accomplish this object, according to the invention there is provided an apparatus for supporting reduction rolls in a rolling mill comprising:

a mill housing, support structures disposed within the mill housing for individually supporting the reduction rolls, load cell means disposed between one of the support structures and the mill hosing, and support element means disposed between each of the other support structures and the mill housing, wherein the overall rigidity of a first support system consisting of said support element means and the corresponding support structure is equal to the overall rigidity of a second support system consisting of said load cell means and the corresponding support structure.

According to this arrangement, the overall rigidity of each of the support systems for the reduction rolls is equal to that of another support system irrespective of the presence or absence of load cell means. This insures uniform elastic displacement of the reduction rolls when a rolling force is applied to the reduction rolls. Therefore, despite the fact that load cell means is installed with respect to only one of the reduction rolls, no inconvenience will be caused to rolling operation. Furthermore, the invention provides for simplification of a draft control system associated with the reduction rolls and cost reduction.

DESCRIPTION OF THE PREFERRED EMBODIMENT

Figure 3:
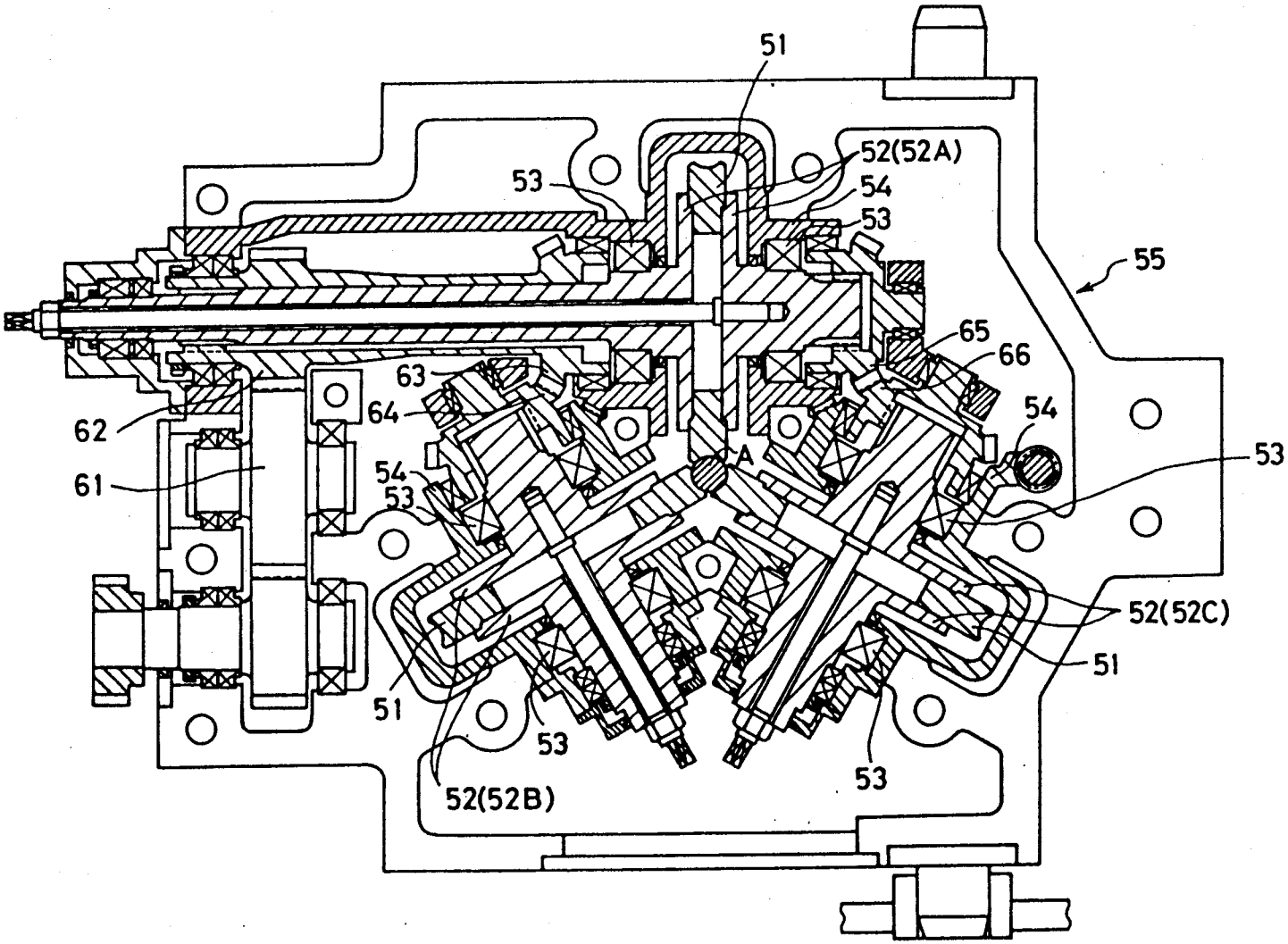
FIG. 3 is a sectional view showing a three-roll rolling mill in which the apparatus of the invention is employed.

As FIG. 3 shows in detail, three reduction rolls 51 are radially arranged at angular intervals of 120 degrees in a vertical plane for rotation so that rolling strip A is rolled from three peripheral sides into a metal bar, wire rod, or the like.

Figure 4:
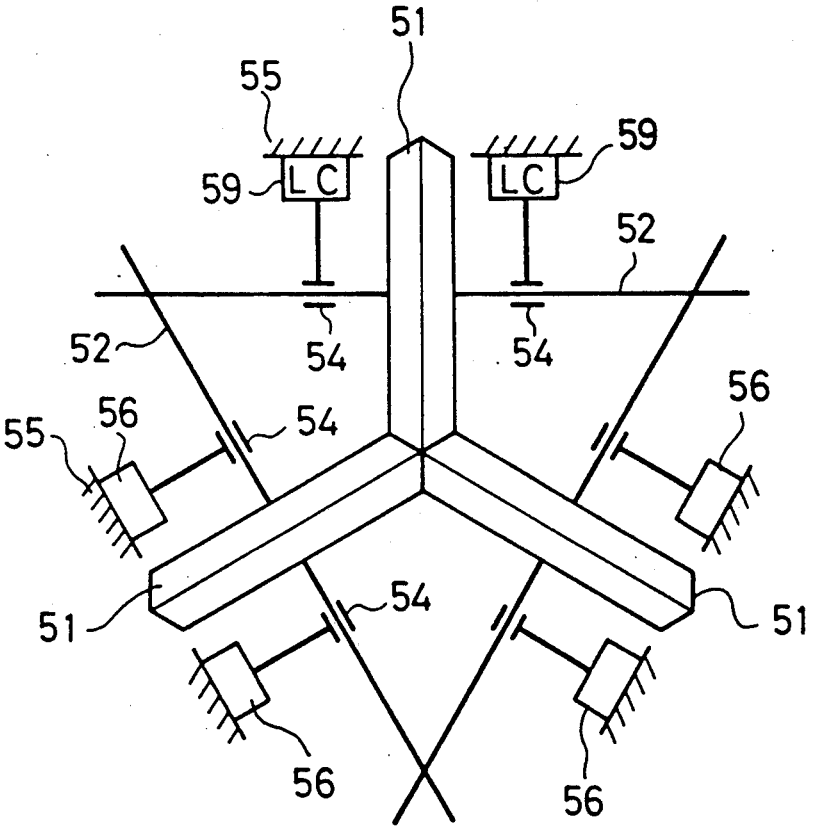
FIG. 4 is a view schematically showing the rolling mill in FIG. 3.

Each reduction roll 51 is held by a roll holder 52 which is rotatably supported in a cylindrical support frame 54 through bearings 53 in eccentric relation to the cylindrical support frame 54. As shown in FIG. 4, a pair of load cells 59 are disposed between one of the three cylindrical support frames 54 and a mill housing 55 in which the cylindrical support frames 54 are housed and longitudinally of the corresponding roll holder 52.

As stated above, each roll holder 52 is supported in the corresponding cylindrical support frame 54 in eccentric relation thereto. It is intended by this that as the cylindrical support frames 54 are rotated, the roll holders 52 or reduction rolls 51 are moved relative to the rolling center for rolling draft control.

Nextly, drive systems for individual reduction rolls 51 will be described. First roll holder 52A is rotated through an input-side gear 61 and a driving cylinder 62. Second roll holder 52B is rotated through a pair of bevel gears 63, 64 associated with both the driving cylinder 62 and the second roll holder 52B. Third roll holder 52C is rotated through a bevel gear 65 mounted to the first roll holder 52A and a bevel gear 66 mounted to one end of the third roll holder 52C which are engaged with each other.

It is noted that each respective bevel gear and the corresponding roll holder are engaged with an internal gear in order to facilitate movement of the corresponding reduction roll 51 in the direction of screw down.

Figure 1:
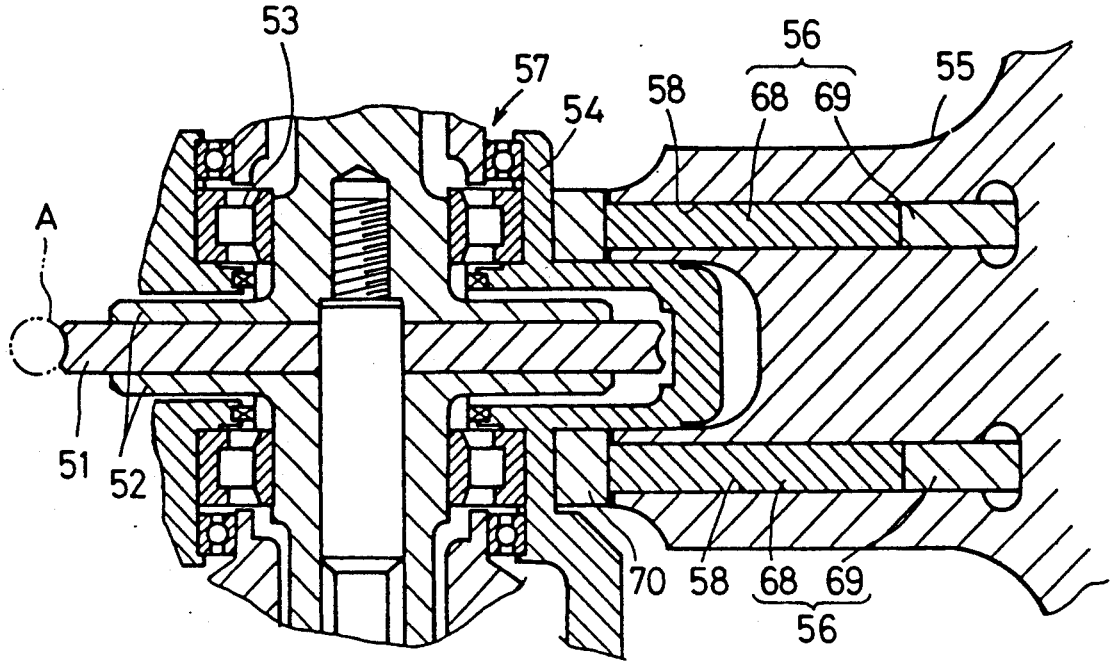
FIG. 1 is a plan view in section showing an apparatus for supporting reduction rolls according to one embodiment of the invention.
Figure 2:
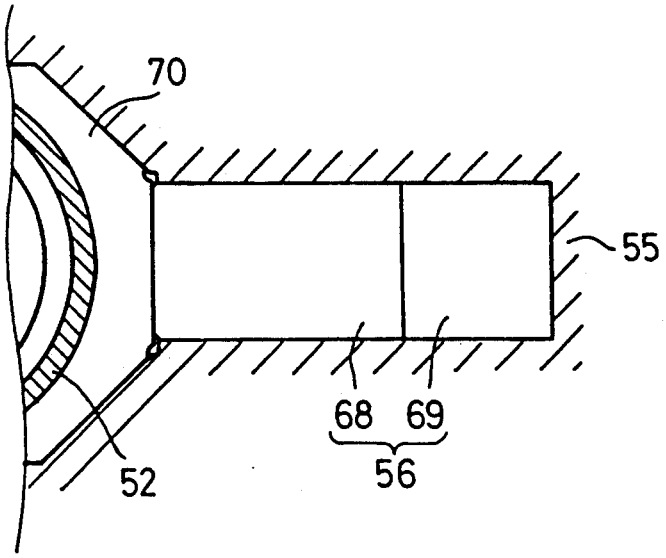
FIG. 2 is a front view of the portion shown in FIG. 1.

FIGS. 1 and 2 are views showing in detail one embodiment of the supporting apparatus of the invention, more particularly a support arrangement in a three-roll rolling mill wherein each cylindrical support frame 54 for supporting the corresponding reduction roll 51 through roll holder 52 is supported in the mill housing 55.

As stated above and shown in FIG. 4, a pair of load cells 59 for measuring a rolling force with respect to one reduction roll 51 is interposed between a particular one of the three cylindrical support frames 54 and the mill housing 55.

As FIGS. 1 and 2 show, a support member 56 is interposed between each of the two other cylindrical support frames 54 which support the corresponding reduction rolls 51 through respective roll holders 52 and the mill housing 55 in which the cylindrical support frames 54 are housed. The rigidity of the support member 56 is set to a value such that the overall rigidity of a first support system consisting of the support member 56 and a support structure 57 for the corresponding reduction roll 51(which structure consists of the corresponding roll holder 52 and cylindrical support frame 55) is equal to the overall rigidity of a second support system consisting of the load cells 59 and a support structure for the reduction roll 51 with respect to which the load cells 59 are provided.

More particularly, in the mill housing 55 there are formed grooves (or recesses) 58 at two locations spaced longitudinally of each of the two other support frames 54, one support member 56 each being received in the two grooves 58.

Each support member 56 consists of two plate members 68, 69 of different materials which are longitudinally connected in series.

For example, the one plate member 68 is formed of steel, and the other plate member 69 is formed of a material, such as aluminum alloy or copper alloy, which is considerably different from steel in modulus of longitudinal elasticity. Shown by 70 is a pad interposed between the plate member 68 and the cylindrical support frame 54.

The rigidity of the two plate members 68, 69 in combination which are disposed in series as above described can be equationally expressed as a spring-force parameter in manner as follows.

Where the total length of each support member 56 is represented by L, the length of the one plate member 68 by S, the sectional area of the plate member 68 by A1, the young's modulus of the plate member 68 by E1, the length of the other plate member 69 by L-S, the sectional area of the plate member 69 by A2, and the young's modulus of the plate member 69 by E2, the spring-force parameter for the support member 56 consisting in combination of the two plate members is expressed by the following equation (i):

$$\Delta L/F = S/AE1 + (L-S)/AE2 \quad \text{(i)}$$

where, Δ L represents contraction occuring when rolling force F is applied to the support member.

Through such combination of plate members 68, 69 formed of materials different in Young's modulus (E), with respective lengths and sectional areas of the plate members being adjusted in order, it is possible to arbitrarily set the rigidity of the support member 56 in a certain range.

Therefore, by setting the overall rigidity of the support system consisting of the support member 56 and the corresponding support structure 57 to be equal to the overall rigidity of the support system consisting of the load 59 and the corresponding support structure, it is possible to equalize the amount of displacement under rolling force with respect to all the reduction rolls 51.

In other words, the number of load cells 59 required to be disposed can be minimized by mounting support members 56 in position as dummies for load cells 59, as shown in FIG. 4.

For the rigidity of each load cell 59, a cell body, a casing thereof, and a mounting member therefor are considered.

In the foregoing embodiment, the supporting apparatus for reduction rolls according to the invention is employed in a three-roll rolling mill with a screw-down setting arrangement. It is understood, however, that the invention is not limited to the embodiment. The invention is equally applicable to three-roll rolling mills having no screw-down setting arrangement and any other conventional rolling mills wherein load cells are disposed at two sites, i.e., the operating side and the driving side.

What is claimed is:

1. An apparatus for supporting a plurality of reduction rolls in a rolling mill comprising:

a mill housing, support structures disposed within the mill housing for individually supporting the reduction rolls, load cell means disposed between one of the support structures and the mill housing, support element means disposed between each of the other support structures and the mill housing and accommodated in recess means formed in said mill housing, said support element means comprising two plate members different in Young's moduli and longitudinally disposed in series to equalize an overall rigidity of a first support system consisting of said one of said support structures and the load cell means to an overall rigidity of a second support system consisting of said each of said other support structures and said support element means.

2. An apparatus according to claim 1, wherein said two plate members are variable in their length and/or sectional area.

3. An apparatus according to claim 1, wherein one plate member is a steel plate and the other plate member is one of an aluminum alloy plate and a copper alloy plate.

* * * * *